US007903019B2

(12) United States Patent
Frick

(10) Patent No.: US 7,903,019 B2
(45) Date of Patent: Mar. 8, 2011

(54) PROTECTIVE DEVICE AND PROTECTIVE MEASURE FOR A RADAR SYSTEM

(75) Inventor: Henry Roger Frick, Hettlingen (CH)

(73) Assignee: Rheinmetall Air Defence AG, Zurich (CH)

( * ) Notice: Subject to any disclaimer, the term of this patent is extended or adjusted under 35 U.S.C. 154(b) by 368 days.

(21) Appl. No.: 11/783,604

(22) Filed: Apr. 10, 2007

(65) Prior Publication Data

US 2008/0148930 A1 Jun. 26, 2008

Related U.S. Application Data

(60) Provisional application No. 60/899,415, filed on Feb. 5, 2007.

(30) Foreign Application Priority Data

Apr. 10, 2006 (DE) ..... 10 2006 017 107

(51) Int. Cl.
*H01Q 15/14* (2006.01)
*H01Q 15/00* (2006.01)

(52) U.S. Cl. ..... 342/12; 342/5; 342/13; 89/1.11; 244/117 R; 244/136

(58) Field of Classification Search ..... 342/1–20; 89/1.11; 244/117 R, 136
See application file for complete search history.

(56) References Cited

U.S. PATENT DOCUMENTS 3,068,472 A * 12/1962 Dell Aria ..... 342/13
3,150,848 A * 9/1964 Lager ..... 342/13
3,527,431 A * 9/1970 Wright ..... 342/12
3,836,968 A * 9/1974 Schillreff ..... 342/12
3,841,219 A * 10/1974 Schillreff ..... 342/12
3,992,628 A * 11/1976 Karney ..... 89/1.11
4,130,059 A * 12/1978 Block et al. ..... 342/12
4,134,115 A * 1/1979 Strom ..... 342/12
4,167,009 A * 9/1979 Schwartz ..... 342/12
4,286,498 A * 9/1981 Block et al. ..... 342/12
4,307,665 A * 12/1981 Block et al. ..... 342/12
4,404,912 A * 9/1983 Sindermann ..... 342/12
4,646,098 A * 2/1987 Mattern et al. ..... 342/14

(Continued)

FOREIGN PATENT DOCUMENTS

AU B-34370/95 5/1996

(Continued)

OTHER PUBLICATIONS

"Chaff—Radar Countermeasures"; no author listed; no date listed; copyright in the years 2000-2008; posted on the Internet at globalsecurity.org.*

*Primary Examiner* — Bernarr E Gregory

(74) *Attorney, Agent, or Firm* — Muncy, Geissler, Olds & Lowe, PLLC

(57) ABSTRACT

A protective device and protective measure for a radar system is provided that includes an active countermeasure by using passive emitter and/or decoys. Decoys are thereby utilized that function according to the reflection principle. These decoys are thereby radiated by the vehicle's radar. The radiation reflected by the decoys in the direction of the ARM has the same characteristic as the direct radiation from the radar itself. Thus, the ARM is unable to discriminate between decoys and the actual radar.

15 Claims, 2 Drawing Sheets

U.S. PATENT DOCUMENTS

| | | | | | |
|---|---|---|---|---|---|
| 4,756,778 | A | * | 7/1988 | Deitz et al. | 342/12 |
| 4,990,919 | A | * | 2/1991 | Manoogian | 342/13 |
| 5,049,883 | A | * | 9/1991 | Woodward | 342/12 |
| 5,291,818 | A | | 3/1994 | Bannasch | |
| 5,662,291 | A | | 9/1997 | Sepp et al. | |
| 5,835,051 | A | | 11/1998 | Bannasch et al. | |
| 6,513,438 | B1 | * | 2/2003 | Fegg et al. | 342/12 |
| 6,833,804 | B2 | * | 12/2004 | Atar | 342/10 |
| 6,876,320 | B2 | * | 4/2005 | Puente Baliarda | 342/12 |
| 2002/0149510 | A1 | | 10/2002 | Salzeder | |
| 2003/0137442 | A1 | * | 7/2003 | Baliarda | 342/12 |
| 2004/0227657 | A1 | * | 11/2004 | Atar | 342/10 |
| 2007/0159379 | A1 | | 7/2007 | Bannasch et al. | |

FOREIGN PATENT DOCUMENTS

| | | | | | |
|---|---|---|---|---|---|
| DE | 3612183 | A1 | | 10/1987 | |
| DE | 4115384 | A1 | | 11/1992 | |
| DE | 4437729 | C1 | | 4/1996 | |
| DE | 4444635 | A1 | | 6/1996 | |
| DE | 19546873 | C1 | | 5/1997 | |
| DE | 19601165 | A1 | | 7/1997 | |
| DE | 19617701 | A1 | | 11/1997 | |
| DE | 19638968 | A1 | | 3/1998 | |
| DE | 10050479 | A1 | | 4/2002 | |
| DE | 10117007 | A1 | | 10/2002 | |
| DE | 10346001 | A1 | | 5/2005 | |
| GB | 2036935 | A | * | 7/1980 | |
| GB | 2309070 | | | 7/1997 | |
| JP | 60082875 | A | * | 5/1985 | 342/9 |
| JP | 62054186 | A | * | 3/1987 | 342/13 |
| WO | WO-01/36896 | A1 | | 5/2001 | |

* cited by examiner

PROTECTIVE DEVICE AND PROTECTIVE MEASURE FOR A RADAR SYSTEM

This nonprovisional application claims priority to Provisional Application No. 60/899,415, which was filed on Feb. 5, 2007, and to German Patent Application No. DE 102006017107, which was filed in Germany on Apr. 10, 2006, and which are both herein incorporated by reference.

BACKGROUND OF THE INVENTION

1. Field of the Invention

The present invention relates to a protective device as well as a protective measure for a radar system against an object, in particular against an anti-radiation-missile (ARM) attack.

2. Description of the Background Art

If a stationary and/or mobile radar system is attacked by an ARM, it has been common practice to turn the radar system off. Once the attack is over, the radar system is once again activated, which, in turn, takes up precious time during engagement.

New ARMs are now prepared for this defense tactic, and are looking for their target by other means. For this purpose, they are now equipped with IR seeker heads, active built-in radar, or GPS data etc. Thus, the traditional strategy of avoiding emission by turning off the radar emitter is no longer adequate against new ARMs.

SUMMARY OF THE INVENTION

It is therefore an object of the present invention to provide a new protective device and protective method to reverse this fact.

The invention is based on the idea to fight an ARM with active countermeasures. Active countermeasures could be, for example, the deployment of decoys.

Using decoys to protect ships from end-stage guided missiles is known from DE 103 46 001 B4, whereby a computer-stored deceptive image corresponding to the respective type of missile is utilized.

Deceptive bodies decoying the target are disclosed in WO 01/36896 A1. A further method for providing a decoy target is described in DE 196 17 701 A1. A deceptive body for decoying a target-seeking guided missiles is also the subject matter of DE 196 01 165 A1. Further publications in this class are DE 196 38 968 A1, DE 41 15 384 C2, DE 44 37 729 C1, DE 44 44 635 C2, DE 100 50 479 A1, and DE 36 12 183 A1.

A method and a device for the protection of mobile military facilities against target-seeking guided weapons are also described in DE 101 17 007 A11. However, the solutions listed above relate to the known decoying and camouflaging of objects, which requires as a pre-condition a radar signature of a target, the radar reflection surface, or a radar cross section, or other sources. For deceptive measures, active emitters (decoys) are then deployed. Typically, these are very costly, and in addition, can be deployed only once. Furthermore, these emitters need to be controlled in order to make the deception a success and guide an ARM to the decoy target.

In contrast to the above-listed solutions, passive emitters/decoys are now provided for active countermeasures. Decoys, which function according to the reflection principle, are thereby used. Preferably, these decoys are radiated by their own radar. The radiation reflected by the decoys in the direction of the ARM has thereby precisely the same characteristic as the direct radiation of the radar itself. Thus, the ARM is unable to make the distinction between decoys and the actual radar.

The decoys are made of a reflecting material, for example, aluminum, and are stored in a container and/or canister. In the event of an ARM attack, the container and/or canister can be brought to a defined height and separate into fragments. A cloud of reflecting bodies is thereby generated, which are now radiated, preferably by their own radar. The radiation reflecting towards the ARM is a better target for the ARM because the signal strength is higher than the one originating directly from the radar. The cloud thereby diverts the ARM from its target and guides it past the target.

Different structural variations are possible for the decoys. With dipoles, narrow-band scatter structures are feasible, with other geometries, even broad-band reflection properties are achievable.

A significant benefit over the traditional protective measures is that the radar device continues to operate even during an attack, thus providing important time savings.

Furthermore, these decoys can also be utilized to confuse an IR seeker head. If they also reflect in the IR zone, the IR signature of the surroundings is supplied to the seeker head of the ARM by the decoys. This means that the ARM sees the IR signature of the radar twice, that of the actual radar and its mirror image. If the radar is worked with a hot source, which can only be seen as a mirror image, the ARM, in addition to the radar emission, is also mislead by an IR deception.

Furthermore, the cloud comprised of these reflecting decoys, can also be used to manipulate the ARM's own radar because the cloud can present an object larger than the target, thus becoming more attractive to the ARM radar.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
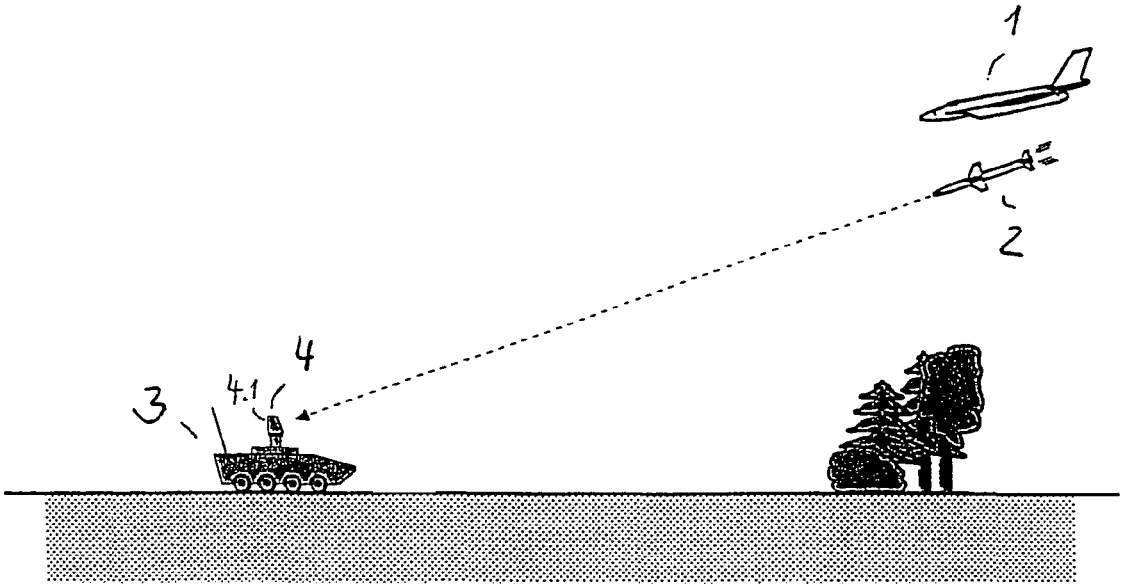
FIG. 1 illustrates an ARM attack.

In FIG. 1, an exemplary scenario is illustrated, whereby from a launcher 1, for example, an aircraft, an ARM 2 is aimed at a vehicle 3 with radar 4, whereby the ARM 2 locks onto the radar signal of radar 4. Radar 4 can be the SKYRANGER Search Radar and Control Centre owned by Oerlikon Contraves AG, for example. In this circumstance, the Search Radar detects the incoming ARM and activates the countermeasure, that is, the protective measure.

Figure 2:
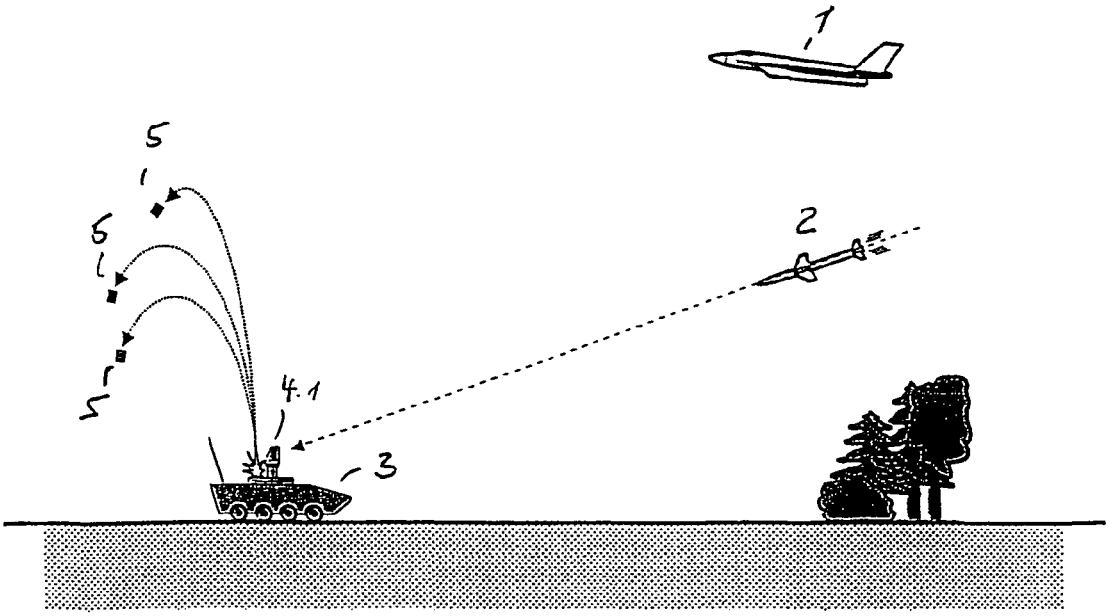
FIG. 2 illustrates a deployment of passive decoys.
Figure 3:
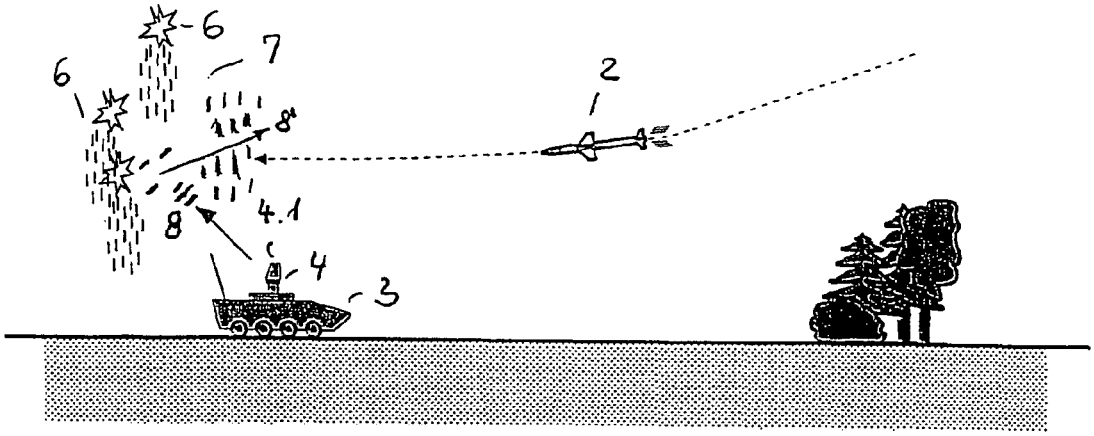
FIGS. 3 and 4 illustrates the ARM locking onto a decoy cloud and flying past the radar.
Figure 4:
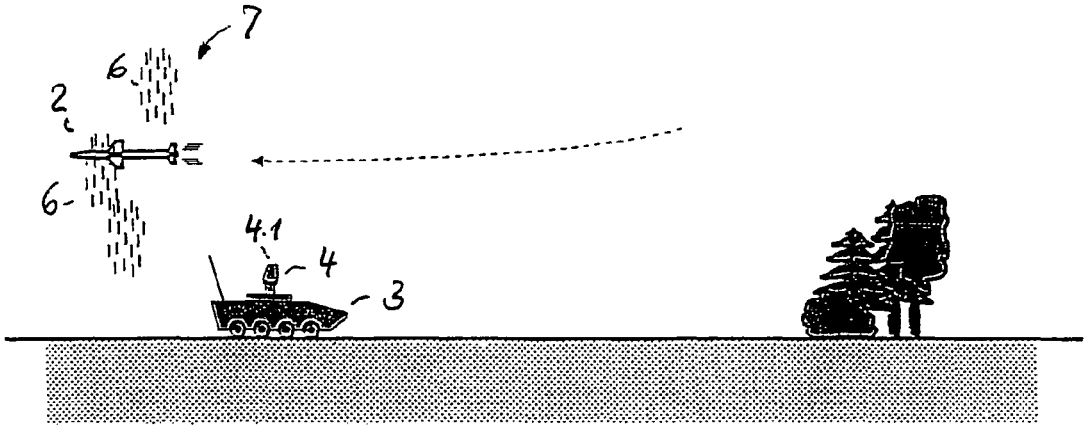

The rotating radar antenna 4.1 is stopped, and oriented in a direction that is opposite to the flight direction of the ARM 2. At roughly the same time, the decoys 5 are thrust upwards, that is, are launched (FIG. 2), which then, radiated by the vehicle's 3 own radar 4, represent an emission source for the ARM 2, to which it locks on, as illustrated in FIG. 3, to fly past the radar 4, and thus past the vehicle 3, at substantially that height (FIG. 4).

The decoys 5 can be provided in a container (not further illustrated) in vehicle 3. A direct proximity to radar 4 is thereby preferred. This container can be brought to a defined height. There, it is opened such that it releases the decoys automatically so that they can accomplish their task.

These band-shaped bodies 5 are manufactured of a conductive material and, for example, have approximately half the wavelength of the emitted electromagnetic field.

Thus, the container releases the decoys for the protective measure. The bodies 5 form a dipole cloud and/or wall 6 of, for example, one-half wavelength behind the radar 4 and acts as a large scattering object 7 (FIG. 3). The radar 4 now radiates this wall 6 (radiation 8), and the seeker of the ARM 2 receives this scattered light (radiation 8). To the ARM 2, this reflected radiation (8') is far more interesting than the radar 4 itself, which, moreover, does not emit in the direction of the attack (FIG. 4).

Vehicle 3 includes all land, air, and water craft (ships) in a traditional sense.

It is understood that methods other than the one known from SKYRANGER for determining the distance of an object flying through the atmosphere can be used here. Such a method, for example, deploying a passive sensor, is described in DE 195 46 873 C1. After detecting the incoming object, the countermeasure is then activated in the described manner. An additional radar, which radiates the decoys 5, could also be provided. However, in this circumstance, the actual radar 4 should be positioned in relation to the attacking ARM 2 such that it is not recognized as a source by the ARM 2.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A protective device for protecting a radar system against an anti-radiation-missile (ARM) attack, the protective device comprising:

decoys for deceiving or interfering with the ARM, wherein the decoys are passive bodies; and a rotating radar antenna configured to turn away from an incoming ARM and towards the decoys, which are radiated by the radar system, and rays from the radar system are reflected by the passive bodies, wherein, behind the radar system, the passive bodies form a three dimensional dipole cloud, suitable for reflection that act as a large scattering object.

2. The protective device according to claim 1, wherein the decoys are located in direct proximity to the radar system.

3. The protective device according to claim 2, including a container holding the decoys.

4. The protective device according to claim 1, wherein the decoys are dipoles with narrow-band scatter structures or broad-band reflection properties.

5. The protective device according to claim 1, wherein the decoys are band-shaped and are made of a conductive material and have a length approximately one-half of the wavelength of the emitted electromagnetic field.

6. The protective device according to claim 1, wherein the decoys also deceive and interfere with an IR seeker head.

7. The protective device according to claim 1, wherein the dipole cloud has a radar cross section that is larger than a radar cross section of a vehicle from which it was deployed.

8. The protective device according to claim 1, wherein the decoys are configured to reflect an IR signature of the radar system.

9. The protective device according to claim 1, wherein the decoys are stored in direct proximity to the radar system.

10. A method of protecting a radar system against an anti-radiation missile (ARM) attack comprising:

detecting an incoming ARM;

turning a radar antenna of the radar system away from the incoming ARM;

launching a plurality of decoys comprising conductive elements to form a dipole cloud; and irradiating the dipole cloud with the radar system;

whereby, the incoming ARM detects the dipole cloud as a radiation producing source and targets the dipole cloud instead of the radar system.

11. The method of claim 10 wherein said launching a plurality of decoys comprises launching a plurality of decoys having a length equal to one half the wavelength of an electromagnetic field emitted by the radar system.

12. The method of claim 11 wherein the incoming ARM approaches the radar system from a first direction and wherein said launching a plurality of decoys comprises launching a plurality of decoys in a second direction opposite from the first direction.

13. The method of claim 10 including launching infrared emitting devices.

14. The method of claim 10 including reflecting an IR signature of the radar system from the decoys.

15. The method of claim 10 wherein said launching a plurality of decoys comprises launching a plurality of decoys having a length approximately half the wavelength of an electromagnetic field emitted by the radar system.

* * * * *